United States Patent [19]

Sapper

[11] 4,235,408

[45] Nov. 25, 1980

[54] SWIVEL-CHAIR FRAME

[75] Inventor: Richard F. Sapper, Stuttgart, Fed. Rep. of Germany

[73] Assignee: Knoll International, Inc., New York, N.Y.

[21] Appl. No.: 881,817

[22] Filed: Feb. 27, 1978

[51] Int. Cl.[2] ..... A45D 19/04; A47J 47/16

[52] U.S. Cl. ..... 248/608; 297/302; 297/306

[58] Field of Search ..... 248/373; 297/301-309, 297/326

[56] References Cited

U.S. PATENT DOCUMENTS

| | | | |
|---|---|---|---|
| 3,027,191 | 3/1962 | Lie | 297/306 |
| 3,131,904 | 5/1964 | Lie | 248/373 |
| 3,162,420 | 12/1964 | Lie | 248/373 |
| 3,240,528 | 3/1966 | Ciuffini et al. | 248/373 |
| 3,480,249 | 11/1969 | Lie | 248/373 |
| 3,669,399 | 6/1972 | Wager | 248/373 |
| 3,868,144 | 2/1975 | Lie | 248/373 |

*Primary Examiner*—James C. Mitchell
*Attorney, Agent, or Firm*—Robert Scobey

[57] ABSTRACT

A swinging-seat swivel chair includes a vertical stud that carries a horizontal hollow pin at the end of which are pivoted two supporting arms for a seat. A torsion bar is housed in the interior of the pin with one end coupled to the pin and the other end coupled to the arm at the other end of the torsion bar. A rigid longitudinal member is included substantially parallel to and spaced from the pin and rigidly interconnecting the arms.

1 Claim, 4 Drawing Figures

SWIVEL-CHAIR FRAME

This invention relates to the frame of a tilting or swivel-chair, that is a frame which supports a seat capable of performing a restricted rotation movement, which is resiliently biased, due to the effect of a force impressed by the back of a sitting person against the chair back.

This kind of chair generally comprises a central stud which rests on the floor through the intermediary of ribs fitted with castors and which bears at the top the chair seat, by means of a pivotal connection. The tilting movement of rotation of the chair seat is governed by a torsion bar.

The bias of the torsion bar must be transferred to both the side arms which carry the chair seat, so that such arms must be rigidly interconnected by a union which withstands any stresses.

Usually, the pivotal union is composed by a fork mounted on the stud, from which hollow pins extend which oscillably carry the hubs of the two side arms. The two hubs are mutually connected by a boxlike member which contains the fork, and the torsion bar is passed through the hollow pins, is fastened to either arm and resiliently biases either of the fixed pivots which emerge from the fork.

Such a structure is difficult to construct, is heavy and is expensive.

Thus, an object of the invention is to provide a supporting frame for a swivelling chair which is very satisfactory from the functional standpoint, is easy to construct, is not bulky and is not expensive.

According to the invention, a vertical chair stud carries a horizontal hollow pin at the end of which two supporting arms for a seat are provided. A torsion bar is housed in the interior of the pin, with one end coupled to the pin and the other end coupled to the arm at the other end of the torsion bar. A rigid longitudinal member substantially parallel to and spaced from the pin and rigidly interconnecting the arms is included.

In order that the objects of the invention may better be understood, and that the essential structural features of the device may be more clearly appreciated, an exemplary embodiment will now be described hereinafter, as illustrated in the accompanying drawings, wherein.

Figure 1:
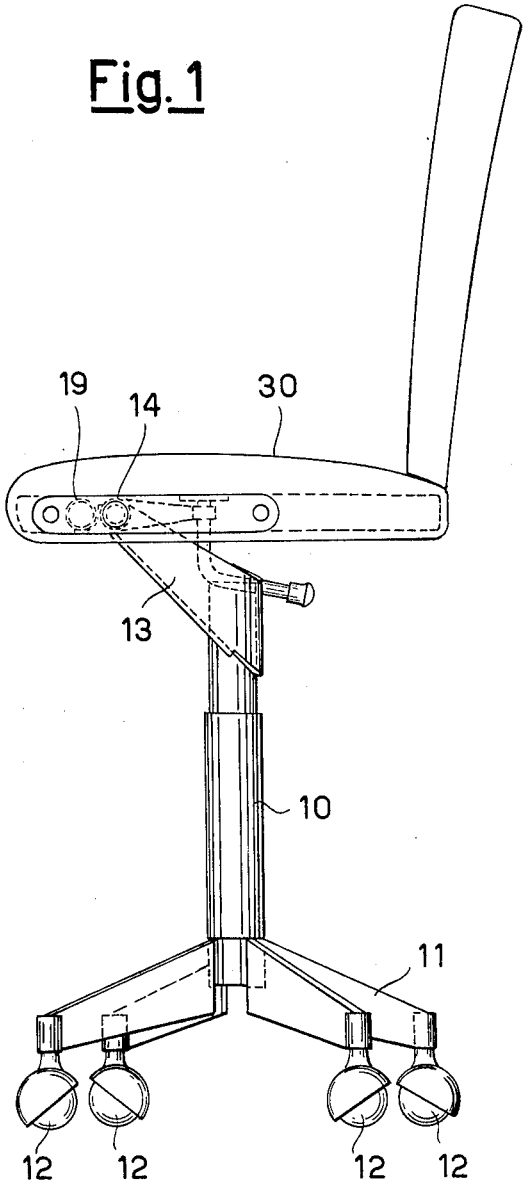
FIG. 1 is a general diagrammatical view of a chair.
Figure 2:
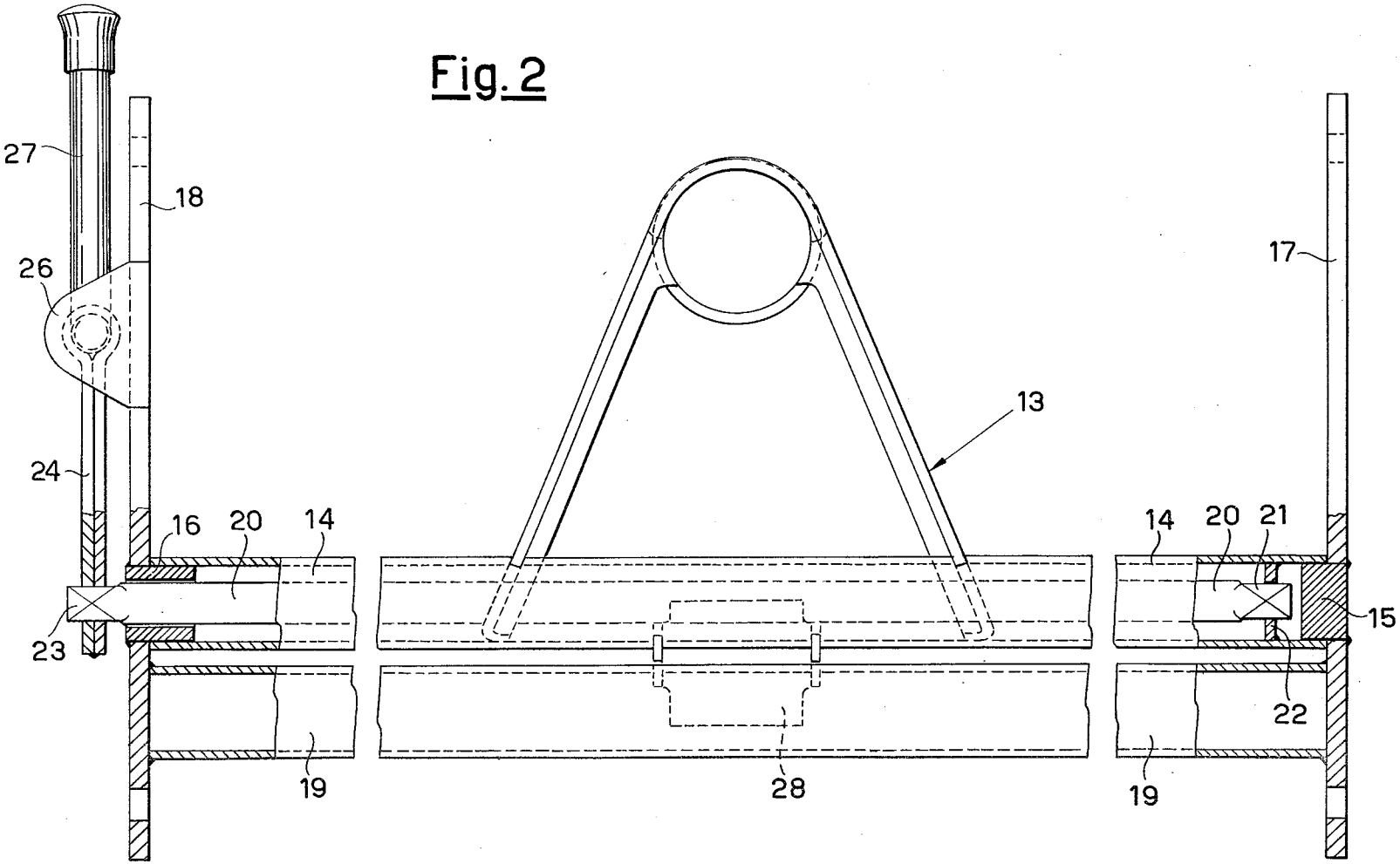
FIG. 2 is a plan view of the chair frame of FIG. 1.
Figure 3:
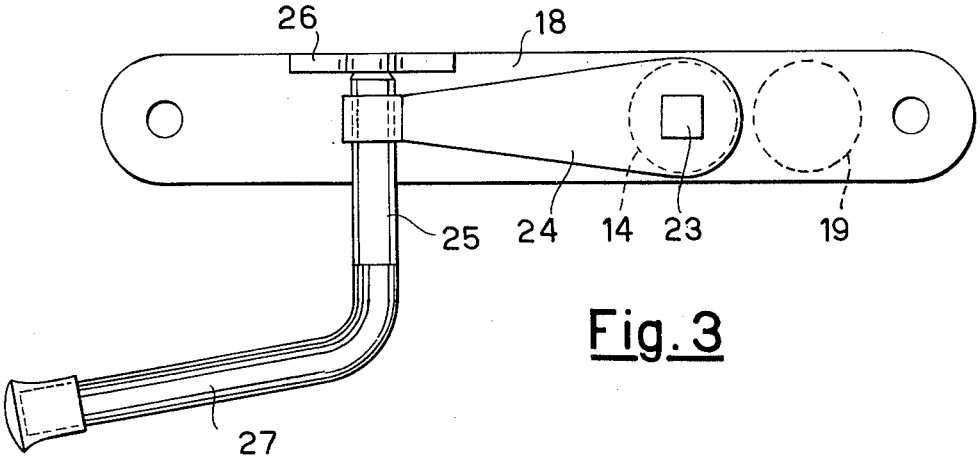
FIGS. 3 and 4 are diagrammatical side elevational views of the frame of FIG. 1.
Figure 4:
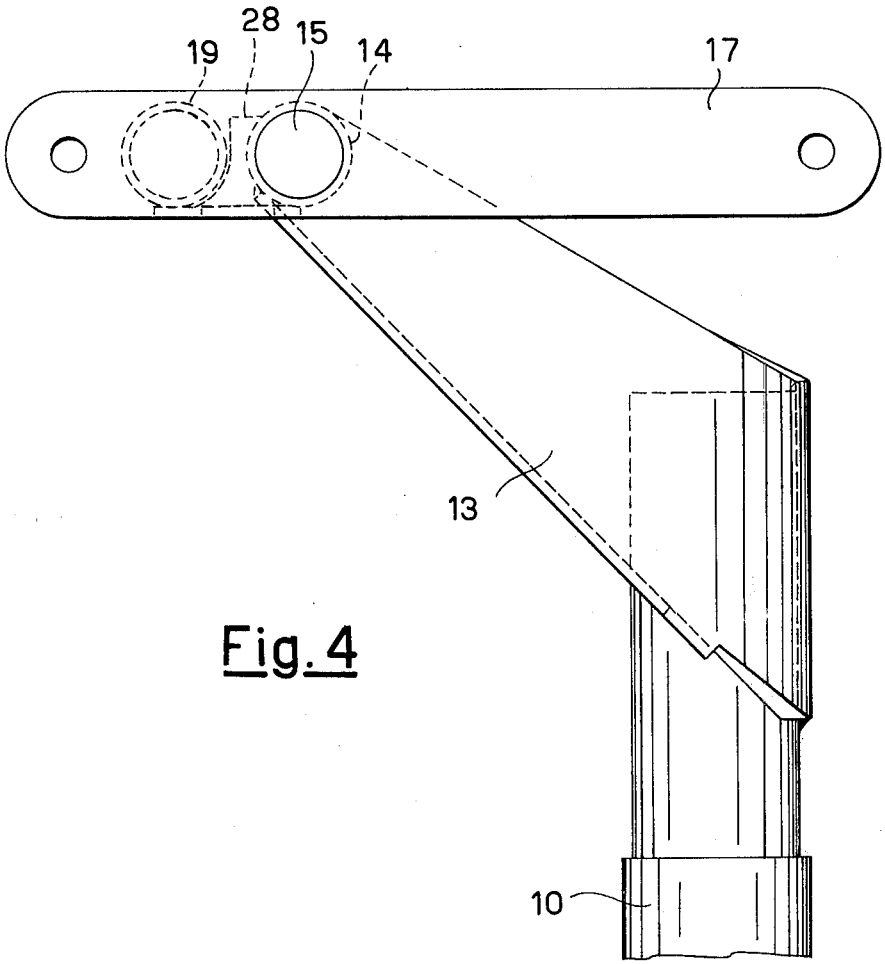

As can be seen in the drawings, the frame comprises a central stud 10, borne by ribs 11, the latter having, at their ends, steering castors 12. The stud carries, at its top, a forked bracket 13, in which is supported and to which is welded a tubular pin 14. To the ends of pin 14 are pivoted, at 15 and at 16, the arms 17 and 18, respectively.

The two arms, then, are mutually connected by a tubular tie 19, welded to such arms by butt-welding. The two arms sustain, in quite conventional a way, a chair-seat 30, the shape of which can be of any desired outline.

A torsion bar, 20, has its polygonal head 21, inserted into a corresponding bore drilled through a diaphragm 22, the latter being welded to the tubular pin 14 mentioned above. The end of the bar 20 remote from the head 21, is shown at 23 and is inserted into a bore of a lever 24; the lever 24 acts, via a screw-threaded pin 25, onto the bracket 26, of the arm 18. A handle 27, enables the pin 25 to be rotated, so as to adjust the torsion bar preload.

The tubular tie 19 abuts an end of stroke abutment or stop member 28, which is welded to the pin 14, so as to prevent a forward tilt of the arms 17 and 18, and thus of the chair seat, irrespective of the torsion bar preload.

From the description above, it will be noted that a swinging-seat swivel chair is described that includes a frame and a vertical stud 10 that carries a horizontal hollow pin 14 at the end of which are pivoted two supporting arms 17 and 18 for a seat. A torsion bar 20 is housed in the interior of the pin 14, with one end coupled to the pin, as at 21 and 22, and the other end coupled to the arm at the other end of the torsion bar, as by 23, 24, 26 and 25. A rigid longitudinal member 19 is included substantially parallel to and spaced from the pin 14 and rigidly interconnecting the arms 17 and 18. Torsion loads are thus absorbed by the rigid longitudinal member or tubular tie 19 connecting arms 17 and 18. The tubular tie prevents the chair (the arms in particular) from absorbing the load and becoming distorted.

The chair frame according to the invention permits reduction of the size of the swivelling system.

A forwardmost arrangement of the pivotal point relative to the central axis, permits a reduction of the upward tilt of the front edge of the chair-seat when the seat is tilted backwards by a person pushing backward against the chair-back.

Thus the seat edge is prevented from reaching such a level as to make cumbersome the resting of the sitting person's feet on the ground.

The simple structure as suggested herein permits that a fully satisfactory sturdiness may be achieved with a minimum weight of materials and simplifies considerably the welding operations, which are in a much smaller number than is conventionally required.

The chair mounted on the frame can then be equipped with the usual accessories. For example, the stud 10 is telescopable in order to match the level of the seat relative to the ground according to the sitting person's stature.

I claim:

1. In a swinging-seat swivel chair that includes a frame comprising a vertical stud carrying a horizontal hollow pin at the end of which there are pivoted two supporting arms for a seat, and a torsion bar being housed in the interior of the pin with one end coupled to the pin and the other end coupled to the arm at said other end of the torsion bar, the improvement comprising a rigid longitudinal member substantially parallel to and spaced from said pin and rigidly interconnecting said arms.

* * * * *